United States Patent [19]

Dixon

[11] Patent Number: 4,881,941

[45] Date of Patent: Nov. 21, 1989

[54] SUPPRESS DYEING METHOD

[75] Inventor: Michael W. Dixon, Dallas, N.C.

[73] Assignee: Sandoz Ltd., Basel, Switzerland

[21] Appl. No.: 217,800

[22] Filed: Jul. 12, 1988

[51] Int. Cl.[4] ..... D06P 5/00; C09B 67/00

[52] U.S. Cl. ..... 8/482; 8/445; 8/446; 8/531; 8/532; 8/533; 8/534; 8/580; 8/917; 8/918; 8/924; 8/927

[58] Field of Search ..... 8/445, 446, 482, 580

[56] References Cited

U.S. PATENT DOCUMENTS

| | | | |
|---|---|---|---|
| 1,668,934 | 5/1928 | Bracewell | 8/483 |
| 1,871,920 | 8/1932 | Senior | 8/486 |
| 2,429,935 | 10/1947 | Jones et al. | 8/446 |
| 2,823,092 | 2/1958 | Spencer | 8/446 |

FOREIGN PATENT DOCUMENTS

| | | |
|---|---|---|
| 3023223 | 1/1981 | Fed. Rep. of Germany . |
| 49-619187 | 7/1974 | Japan . |

*Primary Examiner*—A. Lionel Clingman

*Attorney, Agent, or Firm*—Gerald D. Sharkin; Richard E. Vila; Thomas C. Doyle

[57] ABSTRACT

A textile substrate is dyed by immersing it in a gathered configuration into an oil medium containing a dissolved or dispersed dye for a sufficient time to allow the oil medium to come into contact with part but not all of the surface of the substrate and the thus-treated substrate is then preferably immersed in an aqueous medium having another dye dissolved or dispersed therein.

18 Claims, No Drawings

SUPPRESS DYEING METHOD

This invention relates to a method for producing bi- and multicolored effects on a textile substrate.

The invention comprises imparting a color to part of a textile substrate by applying a dye (hereinafter referred to as "dye 0") from an oil medium to part but not all of the surface of the textile substrate.

The other colors necessary for the bi- or multicolored effect are obtained by:

1. leaving undyed that portion of the textile substrate not dyed by dye 0;
2. dyeing the substrate by one or more ground dyeings prior to dyeing with dye 0;
3. Subsequent to applying dye 0 applying a water-soluble or water-dispersible dye (hereinafter "dye A") from an aqueous medium to at least part of the surface of the textile substrate not contacted by dye 0;
4. a combination of 1 and 3; or
5. a combination of 2 and 3

The term "dye" as used herein is intended to include pigments. It is also intended to include mixtures of dyes or pigments.

Preferably, dye 0 is applied to the substrate by introducing the substrate into an oil medium containing said dye in a dissolved or dispersed state. More preferably, dye 0 is in the dissolved state. It may be dissolved directly in the oil medium; but more usually it is dissolved in a suitable solvent to form a concentrate or paste which, in turn, is mixed with the oil medium.

Dye 0 is one which is capable of imparting a desired color to the particular textile material to be treated. Oil-dispersible pigments may be used. Preferably, however, dye 0 is one which is soluble in the oil medium or in an organic solvent which, in turn, is soluble in or miscible with the oil medium. Preferred dyes are those which are known in the art as solvent dyes. Such dyes comprise an art-recognized class which is disclosed in the Colour Index, third edition (1971), volume 3, pages 3563–3648. Where a further color is to be effected by option 3 above, it is preferred to use as dye 0 a dye with little or no solubility in water.

The oil medium is preferably sufficiently viscous that it does not readily wick, e.g. migrate by capillary action, into the fibers of the textile substrate in those areas where it has not been applied. Animal, vegetable or mineral oils, as well as synthetic oils may be used for this purpose. These include corn oil, peanut oil, cottonseed oil, sunflower oil, olive oil, linseed oil and mineral oil. Vegetable oils have been found to be quite suitable, especially those which have little or no color or odor.

As solvents for dye 0 there may be used those solvents conventionally used for solvent dyes, as disclosed at the above-mentioned pages of the Colour Index. The choice of solvent will depend on the solubility of the particular dye(s) therein. Of course, a solvent should be used which has no adverse effect on the particular textile material being dyed. As disclosed at the aforementioned page 3563 of the Colour Index, mixtures of solvents may be used. Particularly when further coloration is to be effected by option 3 above, it is preferable to use as little as necessary of solvents which are water-soluble or -miscible Small amounts of such solvents, e.g. acetone or methyl ethyl ketone, may be useful to help dissolve certain dyes, but these are advantageously supplemented by non-water-miscible solvents, such as dioctyl phthalate or mineral spirits.

Where a solvent other than the oil medium by itself is used to dissolve dye 0, it is preferably used in an amount of about 1 to 20%, more preferably 3 to 15%, especially 5 to 10%, by volume, of the total amount of solvent plus oil.

The textile material to be dyed by the method of this invention may be any material which can be colored with a dye 0 of the type mentioned above, e.g. cellulosics, such as cotton and rayon, natural and synthetic polyamides, such as wool, silk and nylon, polyacrylonitrile, and blends of such fibers with each other or with other fibers such as polyester. Cellulosic fibers, especially cotton, either alone or blended with polyester, are especially suitable for treatment according to this invention.

The textile substrate may be in woven or knitted form or in the form of yarn. It is important that it be in such a configuration that the oil medium containing the dye 0 is able to come into contact with only part of the surface of the substrate during the time that it is applied to the substrate. More particularly, it should be in such a configuration that even when the substrate is immersed in the oil medium, portions of the surface of the immersed material are not immediately accessible to the oil medium. Thus, the material should be in a gathered form. By "gathered" is meant that the material is folded, twisted, knotted, wrinkled, bunched up, wadded or otherwise gathered so that the oil medium is prevented from coming into contact with some parts of the surface. For instance, with piece goods this may be accomplished by wadding the material into a ball, while yarn and woven goods in continuous form may be pulled through the oil medium in rope form.

The amount of time for applying the oil medium containing dye 0 to the textile substrate should, as indicated above, be insufficient for said dye to come into contact with the entire surface of the substrate. It will be dictated by the particular type of substrate, its particular gathered configuration, the viscosity of the oil medium and the proportion of the substrate which it is desired to dye with dye 0. It is well within the skill of the dyer to make this determination. Preferably, the textile substrate is immersed in the oil medium for less than 5 seconds, usually about 1 to 2 seconds.

The temperature at which the dyeing from the oil medium is carried out is not critical. It should, of course, be below the flash point of any solvent employed and should also be such that the viscosity of the oil is suitable for effecting the partial dyeing of the gathered substrate. Preferably, the temperature is below 50° C., more preferably in the range 20 to 30° C., especially room temperature.

As indicated above, the dyeing with dye 0 may be the only dyeing which is carried out on the substrate, the second color being provided by the undyed portion of the substrate.

As another option, the substrate can be given a ground color by dyeing it from an aqueous medium with one or more dyes G prior to dyeing with dye 0 as disclosed above. In this manner, the ground color shows through in those areas which are not subsequently dyed by dye 0. The dyeing with dye(s) G can be carried out in any manner and with any dyes which are suitable for dyeing the particular textile material from an aqueous medium.

A preferred embodiment of the invention comprises a combination of the dyeing with dye 0 as disclosed above and option 3 above. Accordingly, the preferred method of carrying out the present invention comprises introducing a textile substrate in a gathered state into an oil medium containing a dissolved or dispersed dye 0 for a time sufficient to enable said dye to contact part but not all of the surface of said substrate, and subsequently introducing said substrate into an aqueous medium having a dye A dissolved or dispersed therein for a time sufficient to enable said dye A to contact at least part of the surface of said substrate not contacted by dye 0.

The dye A to be used for further coloration according to option 3 can be any water-soluble or water-dispersible dye which is useful for imparting the desired further color to the textile material being treated. These include acid, basic, direct and reactive dyes as well as sulfur dyes and water-dispersible pigments. Inasmuch as it is preferred to avoid the use of high temperatures in the dyeing method of this invention, dyes A are preferred which can be used effectively at temperatures of 60° C. or below, preferably 40° C. or below. Most preferred are dyes which are effective at 20 to 30° C., especially room temperature. Good results have been obtained using water-dispersible pigments. Such pigments may be added to the aqueous medium in dry form together with an amount of dispersing agent effective to disperse the pigment therein. More conveniently, aqueous concentrates of predispersed pigments such as those available under the registered trademarks Artilene and Graphtol (Sandoz Chemicals Corp.) are employed.

While a dispersing agent (usually nonionic or anionic) is used to disperse the pigment in the aqueous medium, it will be appreciated that beyond the amount of dispersing agent necessary for this purpose, the presence of surface active agents which could break down the repellancy between the oil medium and the aqueous medium, leading to less well defined color effects, is preferably avoided.

The amounts of dye used in the oil and aqueous dyebaths is not critical and will be dictated by the dyeing characteristics of the individual dyes and the particular shades desired.

The oil medium and the aqueous medium may be employed in separate vessels. However, it is a further advantage of this invention that by selecting an oil medium which is lighter than water, both the oil and the aqueous medium can be employed in a single vessel with the oil medium forming the upper phase of a two phase system.

After applying to the textile substrate the oil medium containing dye 0, as described above, one applies the aqueous medium containing dye A. The aqueous medium will be prevented from contacting those areas already contacted by the oil medium but will readily penetrate those areas to which the more viscous oil could not obtain access. By directing the aqueous medium to only certain available areas of the substrate, it is possible to obtain a tri- or multicolored effect by leaving areas which are undyed or dyed only with a ground color according to option 2 above. Preferably, however, the substrate is immersed in the aqueous medium for a sufficient time, usually a few seconds to enable said medium and dye A contained therein to contact all of the substrate not previously contacted by the oil medium and dye 0.

Where dyes 0 and A are in separate vessels, the textile substrate may optionally be squeezed after the application of dye 0 and prior to application of dye A. This has the effect of removing excess amounts of the oil containing dye 0 and also of causing the oil and dye to penetrate into other areas of the substrate. A further squeezing may be carried out after the aqueous medium containing dye A has been applied.

Where both the oil and aqueous media are in the same vessel, the substrate is immersed into and through the upper oil phase and then immediately into the lower aqueous phase. After removing the substrate from the vessel, it may be subjected to an extraction step to remove excess dye.

Following treatment in the oil and aqueous media and optional extraction of excess dye, the substrate is preferably washed once or twice with cold water.

The thus-treated substrate may optionally be given an aftertreatment with a fixing agent to improve the fastness of the dyeings, as disclosed in U.S. Pat. Nos. 4,410,652; 4,439,203; 4,443,223; 4,452,606 and 4,645,511 and U.S. Pat. application Ser. No. 07/096,662 filed Sept. 15, 1987. The disclosures of the foregoing citations are incorporated herein by reference.

The invention will be illustrated by the following examples.

EXAMPLE 1

Six grams of Savinyl® Red BLSN powder are pasted with 25 cc acetone and to this are added 150 cc dioctyl phthalate. The resulting mixture is stirred until a clear solution is obtained To the resulting solution are added 1825 cc corn oil (Mazola®) to make up 2 liters of the solvent dye-containing oil medium.

In a separate vessel 40 grams Graphtol® Blue 6825-2-20 aqueous pigment dispersion containing 20% by weight pigment are added to sufficient water to form two liters of pigment-containing aqueous medium.

A pair of jeans of undyed cotton denim is wadded up into a ball and immersed in the oil medium at room temperature for 1 to 2 seconds. The garment is removed from the oil phase while being squeezed to remove excess oil and dye. The garment is then immersed in the aqueous medium at room temperature for sufficient time to permit penetration of the areas not contacted by the oil medium (about 2 seconds) and then removed while being squeezed to remove excess pigment and water.

This garment is then placed in a commercial rotary type laundry machine and washed for five minutes with cold water only.

The washed garment is then treated for 15 minutes at 60° C. in a bath containing (based on the weight of the garment) 2-3% Indosol® E-50 (Sandoz Chemicals Corp.), 2% Ceranine® HCA Liquid (Sandoz Chemicals Corp.) and 0.5% acetic acid in sufficient water to give a 20:1 liquor:goods ratio. The thus treated garment is extracted and dried. A garment is obtained which is colored red and blue in a marble-like pattern.

EXAMPLE 2

The dye-containing oil medium from Example 1 is poured into the vessel containing the aqueous medium to form a two-phase system in which the oil phase is the upper layer.

A pair of jeans of undyed cotton denim is wadded up into a ball and immersed into the oil phase for about 2 seconds and then down into the aqueous phase for an additional two seconds, both phases being at room temperature.

After removal of the substrate from the two phase dyebath, the excess dye-containing liquid is extracted and the garment is washed, aftertreated and dried as in Example 1. The resulting garment is dyed in a pattern similar to that obtained in Example 1.

I claim:

1. A method of coloring a textile substrate which comprises applying a dye from an oil medium to part but not all of the surface of the substrate by immersing the substrate in a gathered configuration into the oil medium containing a dye dissolved or dispersed therein for a time sufficient so that the dye-containing oil comes into contact with only part of the surface of the substrate, said dye being one which is capable of imparting a desired color to the substrate and said oil being of sufficient viscosity that it does not readily wick into the fibers of the textile substrate in those areas where it has not been applied.

2. A method according to claim 1 wherein the oil medium is vegetable oil.

3. A method according to claim 1 wherein the dye is a solvent dye.

4. A method according to claim 3 wherein the oil is a vegetable oil.

5. A method according to claim 3 which further comprises predissolving the dye in a solvent suitable for dissolving the particular solvent dye and mixing the resulting product with the oil medium.

6. A method according to claim 1 wherein the textile substrate is cotton.

7. A method according to claim 1 which further comprises the step of applying a water-soluble or water-dispersible dye from an aqueous medium to at least part of the surface of the substrate which was not contacted by the dye-containing oil medium.

8. A method according to claim 7 wherein the dyeing from an aqueous medium is effected by immersing the substrate in the aqueous medium.

9. A method according to claim 8 wherein the aqueous medium contains a water-dispersible pigment.

10. A method according to claim 1 wherein the textile substrate comprises cellulose, alone or blended with polyester.

11. A method according to claim 1 wherein the dye-containing oil medium is applied to the textile substrate in less than 5 seconds.

12. A method according to claim 1 which further comprises dyeing the substrate from an aqueous medium to provide a ground color prior to applying the dye from the oil medium.

13. A textile substrate dyed by the method of claim 1.

14. A textile substrate dyed by the method of claim 8.

15. A method of coloring a textile substrate which comprises dissolving a solvent dye in a solvent therefor, mixing the resulting solution with an oil medium and applying the dye from the oil medium to part but not all of the surface of the substrate by introducing the substrate into the oil medium containing the dissolved dye so that the oil comes into contact with only part of the surface of the substrate, said dye being one which is capable of imparting a desired color to the substrate and said oil being of sufficient viscosity that it does not readily wick into the fibers of the textile substrate in those areas where it has not been applied.

16. A method according to claim 15 wherein the textile material comprises cellulose, alone or blended with polyester.

17. A method according to claim 15 wherein the oil is a vegetable oil.

18. A method according to claim 17 wherein the textile substrate comprises cellulose, alone or blended with polyester.

* * * * *